US006034468A

United States Patent [19]

Wilshaw

[11] Patent Number: 6,034,468

[45] **Date of Patent: *Mar. 7, 2000**

[54] FIELD EMITTER DEVICE HAVING POROUS DIELECTRIC ANODIC OXIDE LAYER

[75] Inventor: Peter Richard Wilshaw, Oxford, United Kingdom

[73] Assignee: Isis Innovation Limited, Oxford, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/776,907

[22] PCT Filed: Aug. 16, 1995

[86] PCT No.: PCT/GB95/01943

§ 371 Date: Feb. 14, 1997

§ 102(e) Date: Feb. 14, 1997

[87] PCT Pub. No.: WO96/06443

PCT Pub. Date: Feb. 29, 1996

[30] Foreign Application Priority Data

Aug. 18, 1994 [GB] United Kingdom ..... 9416754

[51] Int. Cl.[7] ..... H01J 1/02

[52] U.S. Cl. ..... 313/309; 313/336; 313/351; 313/491

[58] Field of Search ..... 313/309, 336, 313/351, 495

[56] References Cited

U.S. PATENT DOCUMENTS

| | | | |
|---|---|---|---|
| 3,745,402 | 7/1973 | Shelton et al. | 313/309 |
| 4,163,918 | 8/1979 | Shelton | 313/309 |
| 4,940,916 | 7/1990 | Borel et al. | 313/306 |
| 5,164,632 | 11/1992 | Yoshida et al. | 313/309 |
| 5,170,092 | 12/1992 | Tomii et al. | 313/309 |
| 5,315,206 | 5/1994 | Yoshida | 313/306 |
| 5,320,570 | 6/1994 | Kane | 313/336 |
| 5,371,431 | 12/1994 | Jones et al. | 313/309 |

FOREIGN PATENT DOCUMENTS

95/07543 3/1995 WIPO .

*Primary Examiner*—Vip Patel
*Attorney, Agent, or Firm*—Wenderoth, Lind & Ponack, L.L.P.

[57] ABSTRACT

A field emitter device comprises a dielectric anodic aluminum oxide layer having pores with wires the front ends of which constitute individual field emitting cathodes, a gate eleectrode overlying a front surface of the layer, and an address electrode overlying a back surface of the layer and in electrical contact with the wires. The problem of short circuit between the gate electrode and the field emitter is overcome by cleaning the pore walls adjacent the gate electrode and/or by selectively dissolving the back ends of individual wires.

11 Claims, 5 Drawing Sheets

FIELD EMITTER DEVICE HAVING POROUS DIELECTRIC ANODIC OXIDE LAYER

BACKGROUND OF THE INVENTION

1. Field of the Invention

This invention is directed to a field emitter device for use in flat panel displays, etc.

2. Description of Related Art

Electron field emitter structures have potential application in many different areas, for example to produce flat panel displays (Field Emitter Displays or FED's) and high frequency electronic devices. In each case the device would consist of an array of many individual field emitting cathodes. In most cases it is desirable that i) electron emission occurs at low voltages, ii) high emission currents per unit area of the device can be achieved, and iii) the capacitance between the cathode and the gate electrode is kept to a minimum.

iv) leakage between cathodes and gate layer is minimised.

The practical reasons for i) and ii) is that this determines the transconductance of the device and hence its maximum operating speed—an important parameter for high speed devices. In addition for FED's, operation at low voltages is attractive since this will lower the cost of the driving electronics used to control image generation. Whilst ii) is advantageous because if many emitters are fabricated per unit area this will tend to average the "flicker noise" that may be associated with each individual emitter so leading to a "cleaner" image.

The reason for iii) is that this also determines the maximum speed at which a device may work and also for relatively low frequency applications such as FED's driving the capacitance of the dielectric contributes substantially to the overall power consumption of the unit.

The reason for iv) is that leakage between the cathodes and gate layer increases the power consumption of the device and also makes uniform display brightness for a FED harder to achieve. This is because current flowing between cathode and gate will not contribute to exciting the display phosphors and thus those areas of a display having large leakage current will be less bright for a given total cathode current.

In order that factors i) to iv) may be realised an ideal field emitter geometry may be postulated. This would comprise i) a very small cathode to gate spacing so as to minimise the applied voltage required to produce field emission. ii) A very high density of field emitters per unit area each capable of delivering substantial current. iii) A thick dielectric separating the gate electrode from the substrate. iv) No electrical contact between the emitters and gate layer.

When aluminium is anodised in an electrolyte having some dissolving power for the oxide, there results a porous anodic aluminium oxide film which may be regarded as consisting of an array of hexagonal cells with a pore in the centre of each cell. When removed from the aluminium metal substrate on which it was formed, this anodic oxide film forms a potentially excellent dielectric layer for such field emitter structures. U.S. Pat. No. 5,164,632 describes an electron emitting element for use in a display device, in which the pores of an anodic aluminium oxide film are filled with metal and constitute electron emitting members, and a gate electrode disposed on one surface of the insulator and having protrusions which protrude into each of the pores. Although in principle the electron emitting members are not in electrical contact with the gate electrode, in practice short circuits are probable and no means is disclosed for dealing with the problem. U.S. Pat. No. 5,315,206 describes similar and related devices.

This invention is based on the realisation that short circuits between the gate electrode and individual field emitter electrodes is a major problem when using dielectric layers of anodic aluminium oxide, and one which must be addressed in order to produce a usable device. There are several related problems:

i) Each individual field emitting cathode that is in electrical contact with the gate electrode does not emit any signal. Since the number of pores in an anodic aluminium oxide film is large, at least about $10^8$ pores $cm^{-2}$ it is possible to tolerate a situation in which a substantial number of individual field emitters is non functional and still get an acceptable signal. Nevertheless, if the problem of short circuits is not addressed, it can be found that more than 99%, e.g. more than 999 per thousand, individual field emitting cathodes are non-functional.

ii) To obtain field emission from these devices, a substantial voltage is applied between the gate electrode on one surface of the anodic oxide layer and a conducting substrate constituting an address electrode overlying the other surface. These potentials may be of the order of volts or tens of volts. When there is a short circuit, through an individual emitter cathode, between the gate electrode and the address electrode, the current that passes may be sufficiently heavy to cause local damage to the device.

iii) When there is a short circuit, through an individual field emitting cathode, between the gate electrode and address electrode, the leakage current between cathode and gate electrode is increased.

iv) The leakage current between the gate electrode and the address electrode through the short circuit may be sufficiently large so as to reduce locally the voltage difference between gate and cathodes due to voltage drops caused by the large current flowing through the gate layer, address layer and the rest of the structure. This voltage drop may be sufficient to prevent other cathodes in the surrounding area emitting.

It is an object of this invention to provide field emitter structures in which these problems are minimised or overcome.

SUMMARY OF THE INVENTION

In one aspect the invention provides a field emitter device comprising a dielectric anodic metal oxide layer having a front surface and a back surface, an array of pores extending through the anodic metal oxide layer from the front surface to the back surface, the pores containing wires having back ends and front ends constituting individual field emitting cathodes, a gate electrode overlying the front surface of the anodic metal oxide layer, and an address electrode overlying the back surface of the anodic metal oxide layer and in electrical contact with the back ends of the wires, wherein there is a low or zero incidence of short circuits between the address electrode and the gate electrode.

If there is a high incidence of short circuits between the address electrode and the gate electrode, the device will not work, for various reasons given above. The maximum permissible proportion of short circuits depends upon various parameters of the device, but it can be safely said that, if there are short circuits through as many as 10% of the wires in the pores of the dielectric layer, the device will not function. Usually the proportion of wires providing short circuits needs to be kept below 1%. The inventors have measured resistance between gate electrodes and address electrodes of devices made by them and get values in the range 2 to 20 Mohm $mm^{-2}$, which suggests that the proportion of short circuits is certainly less than 0.1%, and most probably in the range of 1 in $10^5$ to $10^6$, of the wires in the dielectric layer.

Preferably a resistive layer is present between the back ends of the wires and the address electrode. The provision of a resistive layer in a similar context is described in U.S. Pat. No. 4,940,916. This layer serves two purposes. First it limits the current that can flow through any shorted field emitting cathode so that the total leakage current between the gate electrode and the address electrode is kept small. Second, the resistive layer serves to ballast the individual field emitting cathodes, so that as they begin to emit current as the potential applied to the gate electrode is increased, an increasingly large proportion of the applied voltage is dropped across the ballast resistor rather than the emitter themselves. In this way the current emitted by each individual field emitting cathode is limited so that the good emitters which begin emitting at low applied voltages are not destroyed due to excess emission before slightly poorer emitters emit at higher voltages. Thus a larger proportion of emitters emit and a total current produced by the array is larger.

It will be understood that, notwithstanding the presence of a resistive layer, the back ends of the wires in the dielectric layer are deemed to be in electrical contact with the address electrode. It is envisaged that the resistance is preferably in the range of 10–100 Mohm per field emitting cathode. Depending on the diameters of individual wires, and on the thickness of the resistive layer, this in turn implies that the resistive layer may need to have a resistivity in the range $10–10^4$ ohm cm. The thickness of the resistive layer is envisaged as of the order of 1 $\mu$m, e.g. 0.1 $\mu$m up to 10 $\mu$m or more. Examples of materials for the resistive layer are indium oxide, tin oxide, ferric oxide or zinc oxide, alone in doped form or in admixture. Preferred materials are silicated diamond-like-carbon produced by ion-beam PVD deposition to form a dense well-adhered amorphous carbon coating having a resistivity of about 50 ohm cm to about 2000 ohm cm, MEH-PPV (p-poly(2-methoxy-5-(2-ethylhexoxy)-phenylenevinylene)) and doped or undoped amorphous or polycrystalline silicon.

The gate electrode overlies the front surface of the anodic metal oxide layer. When the gate electrode is formed, it is quite difficult to ensure that the metal being applied does not enter the pores. But gate electrode metal within the pores and overlying the walls thereof, is a major source of short circuits. It is therefore a preferred feature of this invention that metal of the gate electrode is substantially not present within the pores. More particularly, the wall of an individual pore intermediate the gate electrode (overlying the end of the pore) and an individual field emitting cathode (within the pore) is preferably free of any conducting material. Techniques for achieving this are described below.

Despite all precautions, inevitably on occasion an individual field emitting cathode will be in electrical contact with the gate electrode. Preferably the back end of the wire associated with such individual field emitting cathode is not also in electrical contact with the address electrode. A technique for achieving this is described below Preferably an individual field emitting cathode is pointed and is spaced from the walls of the pore and from the gate electrode. The pointed front end of a cathode constitutes an emitter cone, and can readily be provided by means of the Spindt or similar process [See for example (and later works by same author) C. A. Spindt et al., J. Appl. Phys. 47, 5248 (1976)]. Preferably metal of the emitter cone is substantially not present overlying the walls of the pore.

In another aspect the invention provides a method of making a field emitter device by the steps of a) providing a dielectric anodic metal oxide layer having a front surface and a back surface and an array of pores extending through the anodic metal oxide layer from the front surface to the back surface, b) providing wires in the pores having back ends and front ends to constitute individual field emitting cathodes, c) providing a gate electrode overlying the front surface of the anodic metal oxide layer, and d) providing an address electrode overlying the back surface of the anodic metal oxide layer and in electrical contact with the back ends of the wires, characterised by taking one or both of the following steps to reduce the extent of short circuits between the address electrode and the gate electrode:

i) subjecting an intermediate product of step c) to a liquid which cleans pore walls intermediate the individual field emitting cathodes and the gate electrode, ii) subjecting an intermediate product of step c) to electrolytic action to selectively dissolve the back end of any wire that is in electrical contact with the gate electrode.

BRIEF DESCRIPTION OF THE FIGURES

Reference is directed to the accompanying drawings, in which.

Each of FIGS. 2 to 13 is a corresponding drawing showing a stage in the production of the device.

DETAILED DESCRIPTION OF THE PREFERRED EMBODIMENT(S)

Figure 1:
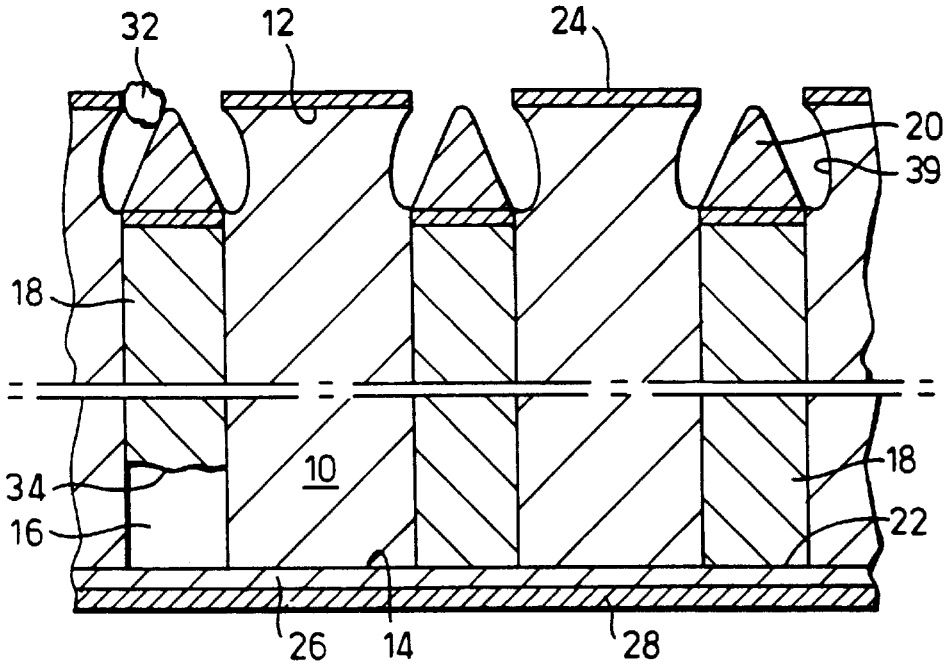
FIG. 1 is a diagrammatic section, not drawn to scale, through a preferred field emitter device according to the invention.

FIG. 1 shows a field emitter device comprising a dielectric anodic metal oxide layer 10 having a front surface 12 and a back surface 14, and an array of pores 16 extending through the layer from the front surface to the back surface. Each pore contains a wire 18 having a back to end 22 and a front end constituting an individual field emitting cathode comprising an emitter cone 20. A gate electrode 24 overlies the front surface of the anodic metal oxide layer. A resistive layer 26 overlies the back surface of the anodic metal oxide layer. An address electrode 28 overlies the resistive surface and is in electrical contact (through the resistive layer) with the back ends of the wires. The emitter cone 20 of two of the three individual field emitting cathodes shown is spaced from the gate electrodes and from the pore walls which are concave at 39. In the left hand pore, a particle 32 has brought the field emitting cathode into electrical contact with the gate electrode. In this pore, the back end of the wire 18 has been selectively dissolved away at 34 and is not in electrical contact with the address electrode 28. Thus in the embodiment shown, there are no short circuits between the address electrode 28 and the gate electrode 24.

In the preferred embodiment described below, the dielectric layer 10 is an anodic aluminium oxide layer; wires 18 are of nickel having emitter cones 20 of molybdenum, and the gate electrode 24 is of niobium. The resistive layer 26 may be for example of amorphous silicon. The address electrode 28 may be of any of a variety of metals e.g. Al, Ag, Cr, W, Nb, Ta or Ti.

The method of the invention starts with a free-standing dielectric anodic metal oxide layer. Free-standing anodic aluminium oxide films are available for purchase in a form convenient for use, for example from Whatman plc under the trademark ANOPORE. Film thickness is not of critical importance, provided that the film is sufficiently robust and may conveniently be in the range 10–150 $\mu$m. Pore diameter and pore spacing are not very critical, but pore spacing needs to be sufficient to permit the pores to be cleaned (see steps 6 and 10 below) without causing the whole structure to collapse. The inventor had found it convenient to use an asymmetric Anopore membrane having a thickness of 60 $\mu$m, a pore diameter of 0.16 $\mu$m adjacent the back surface and a pore diameter of 0.02 $\mu$m adjacent the front surface (the small diameter pores are removed during processing as described below). Alternatively, it is possible to make anodic aluminium oxide films and to give them special properties which may be of advantage in these field emitter devices.

When aluminium is anodised in an electrolyte having some dissolving power for the oxide, there results a porous anodic aluminium oxide film which may be regarded as consisting of an array of hexagonal cells with a pore in the centre of each cell. The diameter and spacing of the pores depends on the anodising voltage; when this is X Volts, the pore diameter is typically about X nm and the pore spacing about 2.5X nm. Between the bottom of the pores and the metal/oxide interface is a barrier layer of thickness about X nm. The total thickness of the porous anodic oxide layer increases with increasing anodising time Thus anodising conditions, including time, voltage and electrolyte composition and temperature, can be chosen in known manner to create an anodic oxide film of chosen thickness containing a uniform array of pores of chosen diameter and spacing.

For present purposes, the thickness of a free standing porous anodic oxide film should preferably be greater than the pore diameter, often by a factor of 10 or 20 or even substantially more.

In one preferred embodiment, the device of this invention is formed by applying a thin film of aluminium (or other anodisable) metal to a conducting substrate, and subjecting the film to anodising conditions until the whole has been converted to an anodic oxide structure at least 0.5 $\mu$m thick with pores extending all the way through. The desired field emitter device can be built round this structure without removing the anodic oxide film from the conducting substrate which can serve as an address electrode. Alternatively, it is possible to make an anodic aluminium oxide film containing a barrier layer, and then to thin the barrier layer, but stopping the process while the anodic oxide film is still held on its substrate, thus producing a structure in which the pores of the anodic oxide layer are in electrical contact with the conducting substrate.

For the method described below, it is necessary to remove, the barrier layer, and there are various ways of doing this. One technique is described in Alcan EP 178 831B. This is a voltage reduction technique which is described as thinning and eventually removing the barrier layer so that the anodic oxide film floats free of the metal substrate on which it was formed.

Another anodising technique is available to produce improved results. In an array comprising a large number of individual field emitting cathodes, it is almost inevitable that one or more of such cathodes will short circuit with its associated gate metal layer. During formation of the porous anodic oxide layer described above, it is possible to gradually to reduce the anodising voltage for a limited period during the anodising operation and then gradually increase it again. Since pore diameter is proportional to anodising voltage, the gradual voltage reduction results in pore branching with the resultant pores each having a reduced diameter. The gradual voltage reduction may be performed in steps as described in Alcan EP 178 831 B although in the present case the voltage reduction process is preferably stopped well before the film has separated from the metal substrate. For example the reduction process might be stopped at anodising voltages as high as 50 V which would yield ≈50 nm diameter pores. Continued anodisation at reduced voltage leads to a region of the anodic film with narrower pores propagating towards the metal surface. As the anodisation voltage is subsequently gradually increased, which may also be done in stages, the diameter of the propagating pores increases and some pores terminate. If the anodising voltage is increased to a value similar to that used before the voltage reduction process commenced, the resulting anodic oxide film will consist of four regions. In the region I closest to the free surface of the film uniform, straight, parallel pores propagate into the depth of the film. In the next region II, produced during voltage reduction, the pores branch and constrict. If a period of constant reduced voltage is used then this region will contain a region of straight, uniform pores of reduced diameter. In the next region III, produced as the voltage is increased, the pores widen and some terminate. Whilst in the last region IV the pores have a similar diameter and density to region 1. The key feature of this structure is that each pore in region IV is connected to one pore in region I by means of only one, or very few, narrow pores in regions II and III. When these pores are filled with metal (see Step 1 below), the constriction caused by the narrow pores linking pores in region I to pores in region IV may cause the resulting metal "wires" to fuse in the event of a short circuit with the gate metal layer and thus to minimise damage resulting from the short circuit. Each constriction thus acts as a nano-scale fuse capable of preventing device destruction.

Step 1 Deposition of Back Contact for Electroplating

Figure 2:
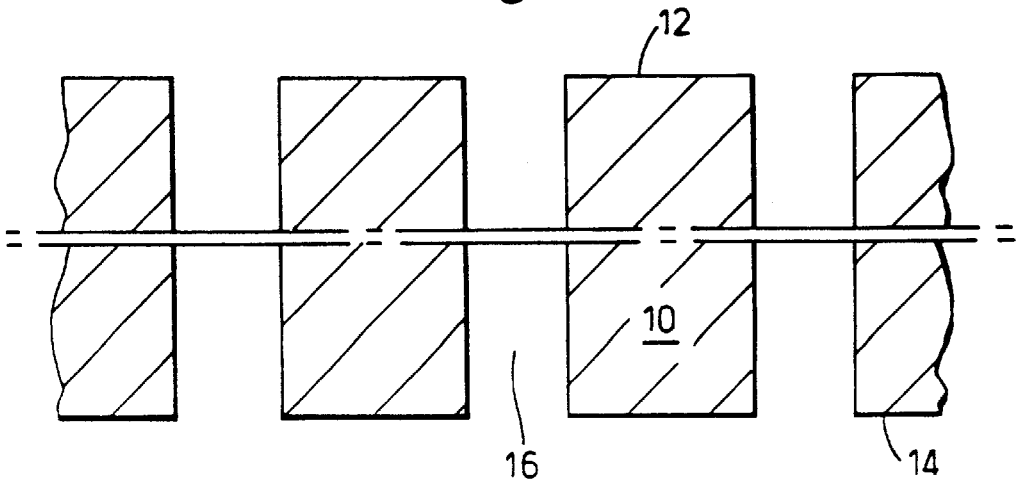
Figure 3:
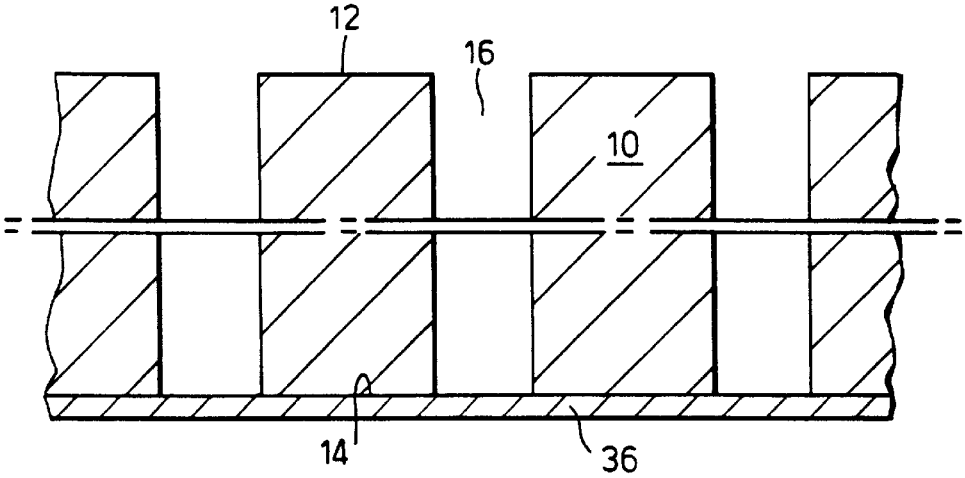

FIG. 2 shows the starting free-standing anodic aluminium oxide membrane 10 having a front surface 12 and a back surface 14 and containing pores 16 here shown as cylindrical. This first step involves depositing a metal layer on the back surface of the membrane shown schematically as a flat metal layer 36 in the structure as shown in FIG. 3. We have found both evaporation and sputtering to work effectively. The metal can be deposited onto either surface but we have obtained best results for electroplating when this metal layer is deposited onto the membrane surface which has the largest pores. Henceforth this will be termed the back surface. We have obtained good results with either copper or silver being used at this step.

Step 2 Electroplating

Step 2 fills the pores with a metal 18 so as to form "wires" connecting the metal layer to the front surface of the anodic oxide film. This may be achieved for example by standard electroplating processes which may be used to plate out, for example Cr or W or Cu or Ag or Mo or Nb etc. in the pores. In each case a negative potential is applied to the metal layer whilst it is immersed in a suitable electrolyte. This will produce the structure shown in FIG. 4. One metal plating system we have used is:

| | |
|---|---|
| 327 g/l | $Ni(NH_2SO_3)_2$ |
| 14.4 g/l | $NiCl_2$ |
| 30 g/l | $H_3BO_3$ |
| 0.129 g/l | Sodium lauryl sulphate |

Figure 4:
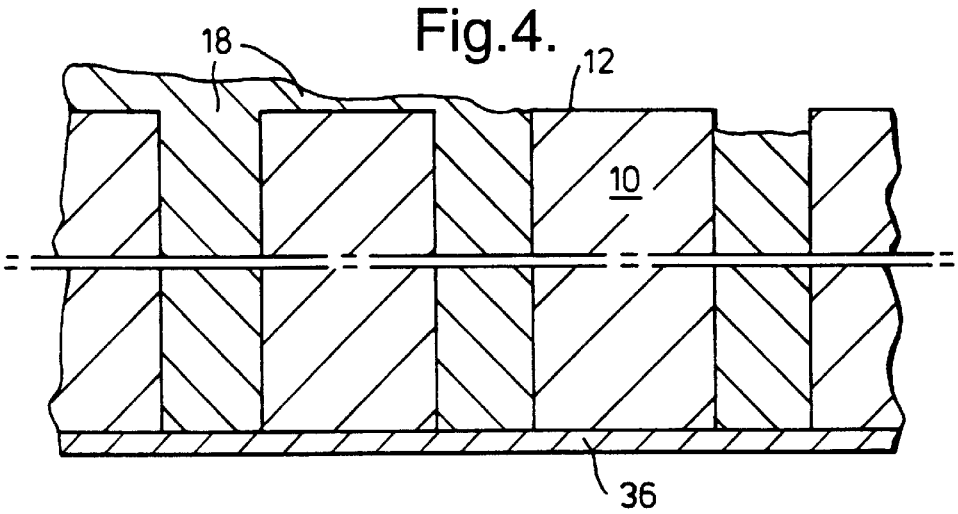

This solution deposits nickel in the pores and we have used current densities of 10 $mAcm^{-2}$ and 3 $mAcm^{-2}$ for periods of either ≈4.5 or ≈15 hours respectively. We have found it advantageous to ensure that the electrolyte only makes contact to the metal layer on the back membrane surface through the pores and not via direct contact with the metal 36. this can be achieved by holding the membrane in a water tight jig such that only the front surface of the membrane is directly immersed in the electrolyte. The electrolyte then penetrates down the pores to the back surface which is covered in metal. When the voltage is applied plating begins in each pore. Other metals may also be plated in this way, for example we have also obtained good results using a copper based plating system; however in the following it will be assumed that Ni has been used. Plating is continued until the pores are full or nearly full. In this way at the end of this step the membrane may contain regions where the plated metal nearly reaches the membrane front surface, regions where it is just at that surface and regions where it has penetrated to the surface and plating has continued to form a continuous layer of metal across the membrane surface. (FIG. 4).

Step 3 Mechanical Polishing

Figure 5:
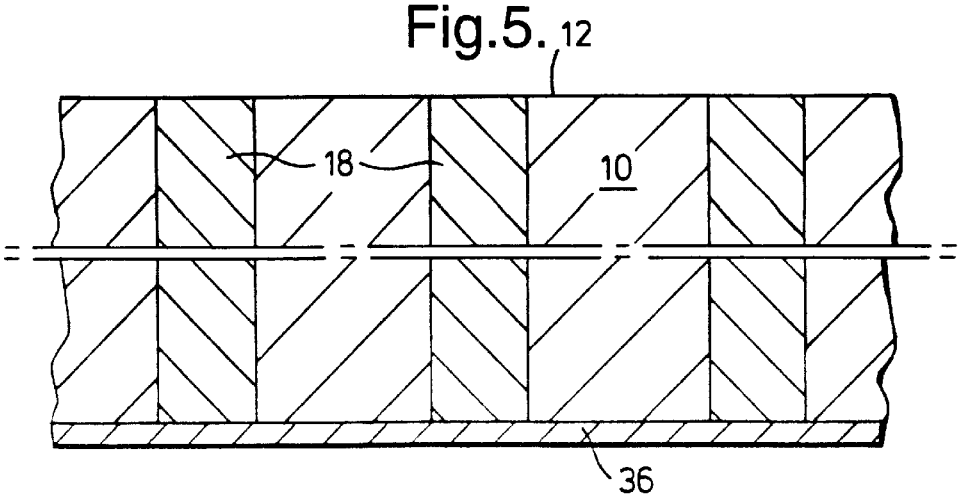

The front surface of the membrane is now polished such that a smooth finish is produced with the nickel in the pores polished flat relative to the surrounding alumina matrix. We normally carry out this step such that 10 to 20 μm of the membrane thickness is removed, by which depth over 99% of all pores are found to be full of Ni. We have found that a satisfactory finish can be achieved with the final polishing being carried out using 0.1 μm diamond paste. The amount of material removed in this process is not critical nor is the uniformity with which it is removed. (FIG. 5).

Step 4 Etching Back the Metal in the Pores

Figure 6:
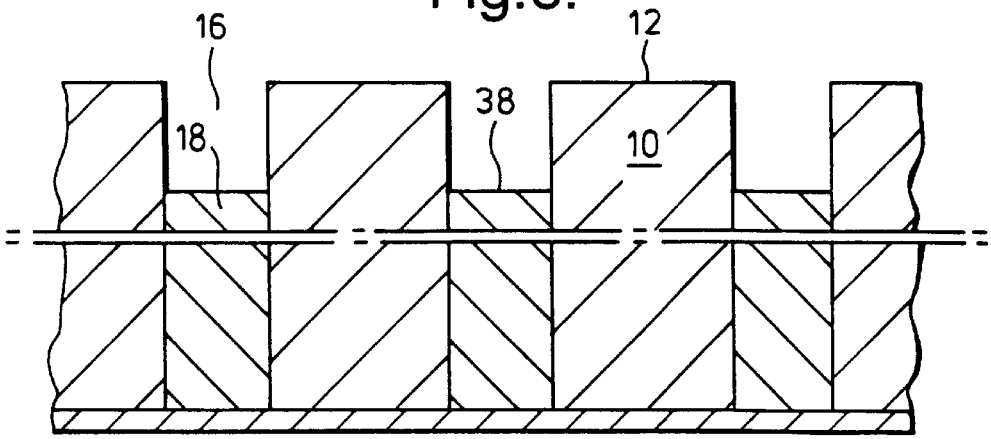

The metal in the pores is now etched back from the front surface of the membrane by an amount very approximately equal to twice the diameter of the pores. Thus in the case of membranes with a nominal pore diameter of 0.16 μm, ≈0.4 μm of metal is etched back. We have found that the etching can be successfully accomplished using an electropolishing technique. In this process the front surface of the membrane is immersed in an electrolyte and a positive voltage is applied to the metal layer deposited onto the back surface in step 1. We have used 4 volumes $H_2SO_4$ added to 3 volumes $H_2O$ as the electrolyte with the polishing performed at 300 $mAcm^{-2}$ current density for approximately 2 seconds or less to remove uniformly and reproducibly the required depth of Ni from 0.16 μm diameter pores. Other etching methods may also be used for example sputter etching or reactive ion etching or a chemical etch may be used. (FIG. 6).

It should be noted that steps 2, 3 and 4 can in principle be combined, by electrodepositing in each pore a controlled amount of metal not quite sufficient to fill the pore. in practice, it is difficult to provide a uniform front end of each metal deposit in this way. So the described technique, involving electroplating followed by polishing and etching is currently preferred.

Figure 7:
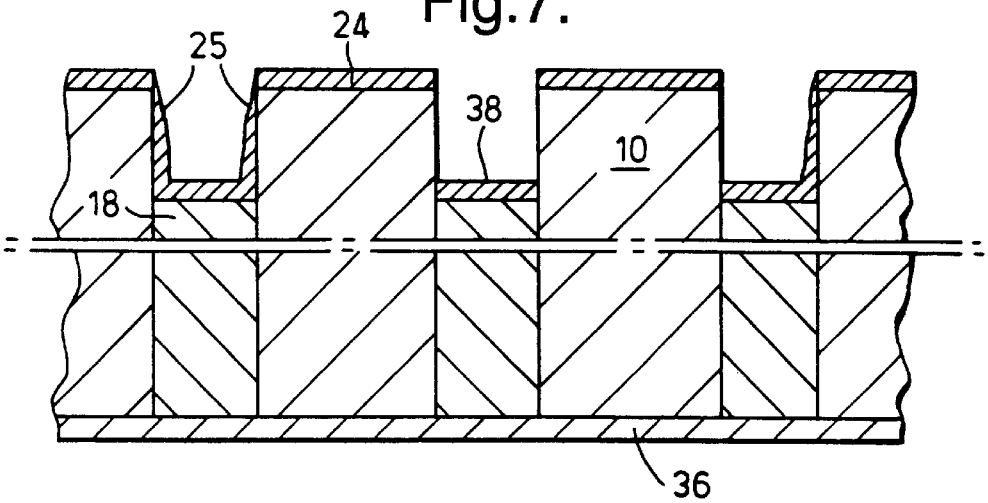

Step 5 Deposition of Gate Layer A thin layer of metal 24 is now deposited at normal incidence on the front surface of the membrane. We have found evaporation of niobium to give particularly good results but gold, titanium and tantalum also work well. The layer thickness deposited is typically in the range 20–40 nm and the metal can be deposited in stripes to facilitate matrix addressing of the emitters. Note: we have not found it necessary to deposit the gate layer at a glancing angle on a rotating substrate and thus our process is readily scaled to large areas. (FIG. 7). The gate electrode metal also deposits at 38 on the front surface of the metal in each pore; and perhaps also on the pore walls as shown at 25. (The thickness of the covering over the pore walls is greatly exaggerated in the Figures).

The next step is the first of a series of steps designed to minimise the incidence of short circuits.

Step 6 Pore Wall under-cutting

In this step the membrane is subjected to the action of a liquid which cleans the pore walls intermediate the individual field emitting cathodes 18 and the gate electrode 24.

Figure 8:
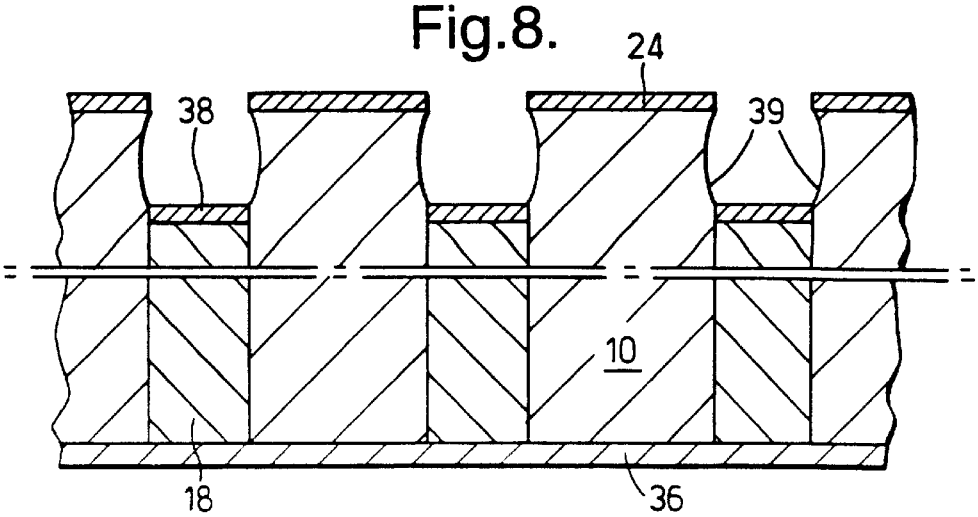
Figure 9:
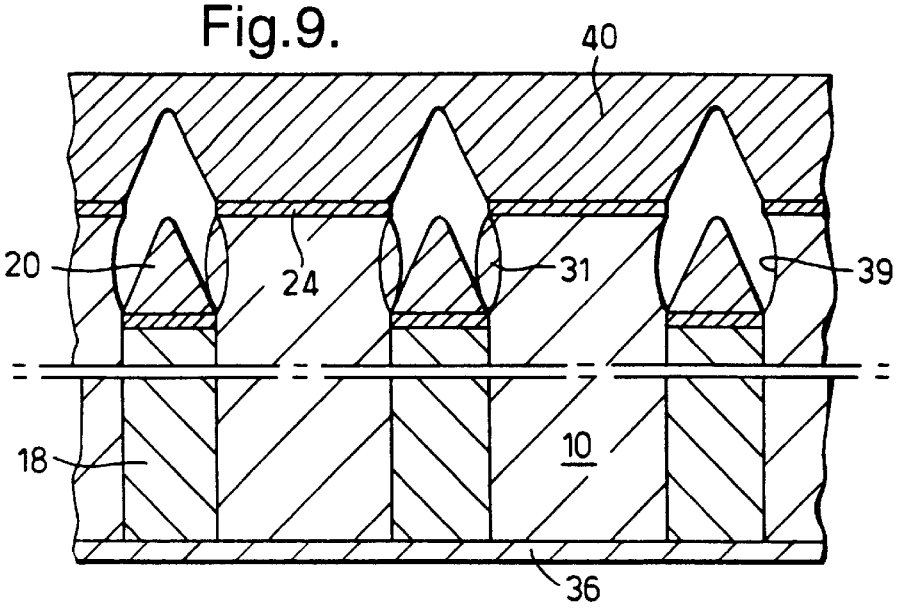

Preferably the membrane is now immersed in a solution of 2 g KOH in 100 g of water for typically between 3 to 12 minutes and good results are obtained using a period of 8 minutes. This has the effect of removing a small amount of alumina from the exposed pore walls so that the gate layer slightly overhangs the surface of the pore walls at 39. In addition if there are small amounts of Nb left on the pore wall after the gate deposition step, this is removed when the alumina underneath is etched away. Thus this step serves to isolate electrically the gate layer from the Ni deposited in the pores. (FIG. 8).

Step 7 Emitter Cone Deposition

Emitter cones are fabricated by deposition of metal perpendicular to the membrane surface. We have found that e-beam evaporation of molybdenum on to the membrane which is heated to ~300° C. works well. Sufficient Mo is deposited so that the pores are closed by a continuous layer 40 and the cones 20 are formed underneath. Using ~0.16 μm diameter pores a 0.5 μm thick layer of Mo is sufficient. Some Mo may be deposited on the pore walls as shown at 31. (The thickness of the layer of Mo is greatly exaggerated in FIGS. 9 and 10).

The apex of the cones in FIGS. 9 to 13 are shown to be coincident with the top of the dielectric layer, it will be immediately apparent that in practice although some of the cones terminate at this position others may be either higher or lower.

Step 8 Removal of Back Metal Layer

Figure 10:
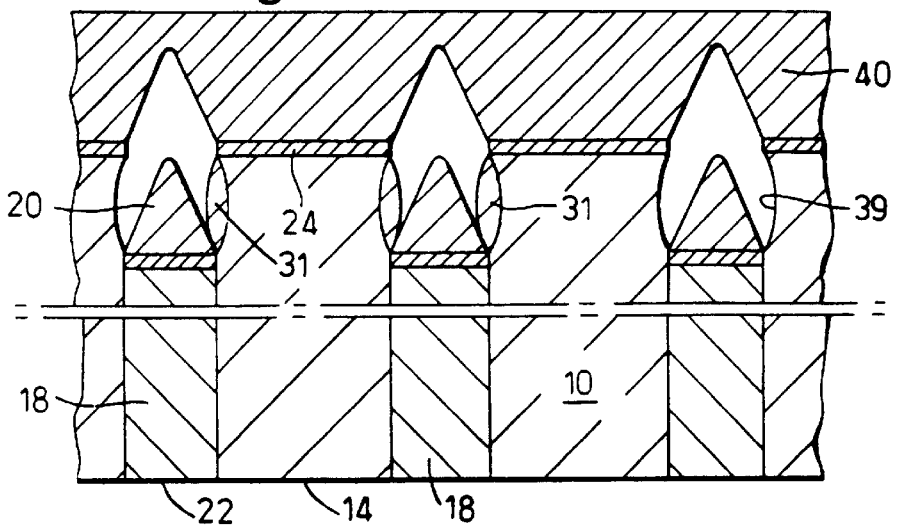
Figure 11:
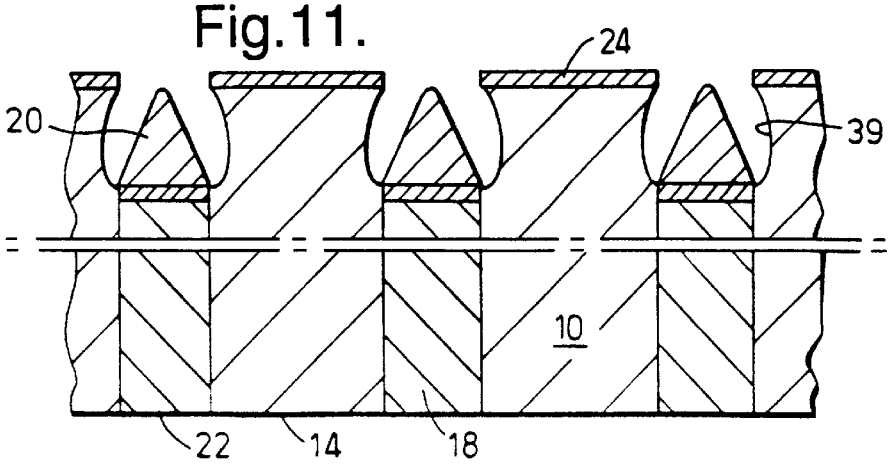

The back metal layer is now removed so that the Ni wires in adjacent pores are no longer electrically connected to each other at the back surface. This can be done by a very light mechanical polish, e.g. 1 μm diamond paste for ~5 minutes, or by a chemical dissolution step or by a combination of both. If copper has been used as the back membrane contact then it can be removed by dipping in a solution of 1 part (3% $H_2O_2$) to 1 part ammonia. In which case the copper is rapidly removed whereas the Ni wires appear to be untouched. In the case of silver being used as the back metal contact a solution of 19 part sulphuric acid to 1 part fuming nitric acid can be used, although in this case the Ni is attacked as well as the silver, although at a much slower rate, and so the membrane must be left in the solution for less than about one minutes so that very little Ni is removed. (FIG. 10).

Step 9 Removal of front metal layer and "cleaning" of pore wall

The top layer of metal on the front membrane surface which blocks the pores which contain the conical emitters is now removed. This can be done electrolytically as we have found to work well or by means of a previously deposited lift-off layer which is deposited between the gate layer and the metal layer used to form the emitting cones. The lift-off layer, if used, is dissolved in a solution which does not attack the cone material this can be done electrolytically by applying a positive voltage to the gate layer or by chemical dissolution. We prefer not to use a lift-off layer and use either an electrolyte of 2 g KOH to 100 g of water or 4 parts sulphuric acid to 3 parts water. When dilute KOH is used as the electrolyte, a potential of 2 to 4 volts is applied to the gate layer. We have found that this cane be done effectively by applying the potential in bursts of 5 seconds with the potential on followed by 15 seconds with the potential off. This is carried out for a total period of approximately 12 minutes. This has the effect that as soon as sufficient Mo is removed so that the electrolyte gains access to the pores, the potential is soon (within 5s) switched off whilst the dilute KOH solution continues to attack the exposed pore walls. In this way any small amount of Mo which has been deposited on these surfaces is cleaned off so breaking electrical contact between the surface Mo layer and the Mo cones. In this way when electrical isolation between the gate layer and the emitters is achieved, no further electrolytic dissolution of the Mo cones can occur which are thus left with sharp points as required for optimum field emission. The removal of Mo can also be performed by using the potential applied continuously for ~3 minutes followed by ~9 minutes without voltage in the KOH solution or by using the sulphuric acid solution at ~2 V for ~3 minutes followed by ~12 minutes in the KOH solution. In each case the final step in KOH is to "clean" up the alumina walls of the pores by dissolving away some of their surface so ensuring electrical isolation between the emitters and the gate layer. If a more concentrated solution of KOH is used shorter times can be used for this step. In some cases we found it desirable to monitor the current flowing whilst the potential was applied to the gate and by noting when this fell below some preset level it could be deduced when all the surface Mo layer has been removed. (FIG. 11. Note that the undercutting 39 of the pores adjacent the gate electrode is more pronounced than the undercutting 39 resulting from step 6 and shown in FIGS. 8 to 10).

It is alternatively possible to apply the emitter cones 20 on the front ends of the field emitter cathodes 18 before the gate electrode 24 is laid over the front surface of the membrane. This requires the use of a lift-off layer (not shown) intermediate the membrane 10 and the Mo layer 40. When using this alternative, it is possible to sharpen the cone emitters by ion bombardment [2] or other means. The gate electrode 24 is then fabricated using for example the method of Lui et al [3].

Step 10 Removal of Shorts

At this stage we have found it advantageous to introduce a further step to mitigate against the effect of shorts between the gate layer and the emitter cones. This is because with $\approx 10^8$ emitters $cm^{-2}$, even after the previous procedures we still find a small proportion of the emitters to be shorted to the gate and with such a large density of emitters present this may lead to too large leakage currents in a finished device. The effect of any remaining shorts is removed as follows. The rear surface of the membrane is exposed to a solution of 4 parts sulphuric acid to 3 parts water and a positive potential of ≈2 to 5 volts is applied to the front surface of the membrane via the gate layer for ≈2 to 10 minutes. In this way any Ni wires in electrical contact with the gate layer (even via a resistance in excess of 1000 Mohms) are electrolytically dissolved from the back surface of the membrane. Ni wires isolated from the gate layer are not effected by this process. When a contact layer is subsequently deposited on the back of the membrane it will not make contact with those Ni wires which were etched back electrolytically and so the effect of the shorts is removed. However the metal layer will contact any Ni wires electrically isolated from the front surface. By inspection of the back surface of the membrane using SEM after this step has been completed it can be seen that ≈1% of Ni wires have been etched back, with several μm of material removed from each, thus indicating that that was the proportion still shorted to the gate layer after the previous processing. If, immediately after this step a back metal contact is deposited it is found that the resistance between this layer and the gate layer is typically between 2 and 20 Mohms $mm^{-2}$. However subsequent handling of the device and application of voltages can lead to new shorts occurring which may reduce this value to the order 5–10 kohms $mm^{-2}$.

Figure 12:
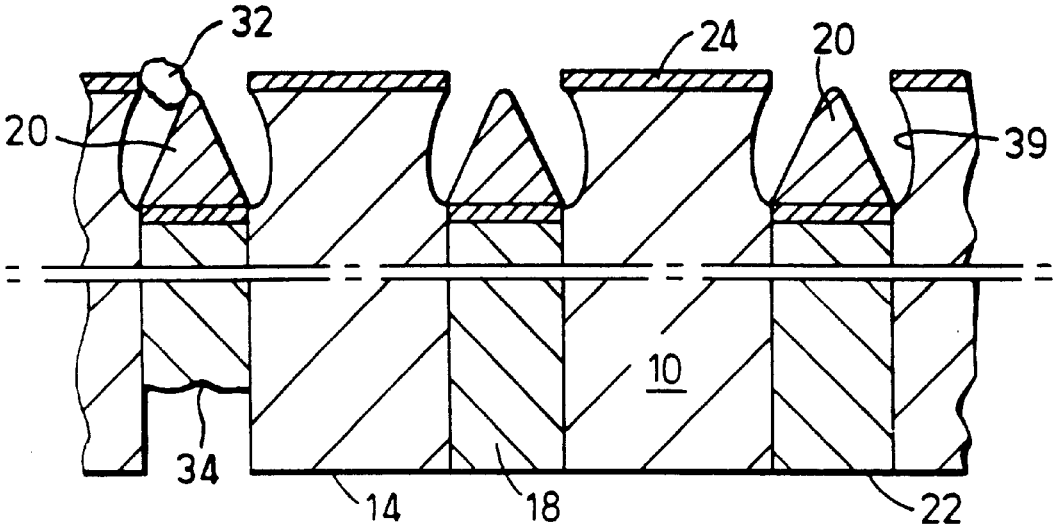
Figure 13:
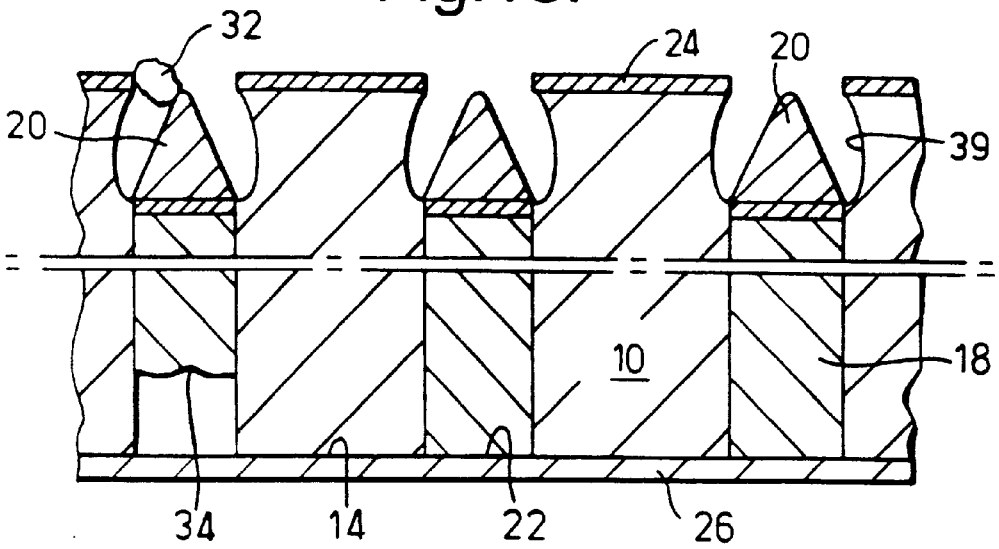

This step is shown in FIG. 12. In this example a conducting particle 32 has brought the cone emitter of an individual field emitting cathode into electrical contact with the gate electrode. The bottom end of that cathode has been selectively dissolved away at 34.

Step 11 Deposition of Back Surface Resistance Layer

In order to overcome the problem of accidentally induced shorts which may occur during use or handling of the membrane, and also to increase the proportion of emitters that emit at any one time during operation, it is advantageous to apply a resistive layer (26, FIG. 13) to the back surface. A layer ≈0.1 to 2 μm thick would be effective and we have tried ≈1 μm thick layers of silicated diamond-like-carbon with a resistivity of 110 ohm cm and also polymer layers of MEH-PPV (p-poly(2-methoxy-5-(2-ethylhexoxy)-phenylenevinylene)) whose resistivity was less well defined. In this way a resistance of about 10 Mohms to about 300 Mohms, e.g. 30–100 Mohms, is formed between the end of each Ni wire and the final metal contact layer applied in the next step.

Step 12 Deposition of back surface contact layers to perform matrix addressing The final step is to deposit the back metal contacts (28, FIG. 1). We have used evaporated aluminium or evaporated silver contacts but other metals and deposition methods such as sputtering would also work. We apply these contacts in the form of stripes perpendicular to the stripes of the gate layer metallisation so that matrix addressing may be performed simply.

In the above preferred embodiment of the method, steps 6, 9, 10 and 11 are all designed to reduce the incidence of short circuits. Step 6 is performed before Mo emitter cones are applied to the front ends of field emitting cathodes; step 9 is performed after application of the emitter cones. Both steps are designed to clean the walls of the pores intermediate the field emitting cathodes and the overlying gate electrode. Although either step may be omitted, preferably both steps are carried out. Step 10 addresses the electrical contact between the back end of the field emitting cathode and the address electrode, and is designed to deal with any remaining shorts. Step 11, the deposition of a back surface resistance layer, is designed to minimise the damaging effect of any remaining short circuits. Although one or more of these steps may be omitted, it is preferred that all four be included.

In tests field emission from samples produced by the method described occurred at 8 V or above. The emitted current varied between samples and increased with increased voltage.

I claim:

1. A field emitter device comprising a porous dielectric anodic metal oxide layer (10) having a front surface (12) and a back surface (14), an array of pores (16) extending through the anodic metal oxide layer from the front surface to the back surface, the pores containing wires (18) having back ends (22) and front ends constituting individual field emitting cathodes (20), a gate electrode (24) comprised of an electrically conducting material overlying the front surface of the anodic metal oxide layer wherein material of the gate electrode is substantially not present within overlying walls of the pores, and an address electrode (28) overlying the back surface of the anodic metal oxide layer and in electrical contact with the back ends of the wires, wherein there is a low or zero incidence of short circuits between the address electrode and the gate electrode, and wherein the front ends of the individual field emitting cathodes are approximately level with the front surface of the anodic metal oxide layer.

2. The device as claimed in claim 1, wherein a resistive layer (26) is present between the back ends of the wires and the address electrode.

3. The device as claimed in claim 1, wherein an individual field emitting cathode has a front end which is pointed and is spaced from the walls of the pore and from the gate electrode.

4. The device as claimed in claim 3, wherein metal of an individual field emitting cathode is substantially not present overlying the walls of the pore.

5. A field emitter device comprising a porous dielectric anodic metal oxide layer (10) having a front surface (12) and a back surface (14), an array of pores (16) having walls extending through the anodic metal oxide layer from the front surface to the back surface, the pores containing wires (18) having back ends (22) and front ends constituting individual field emitting cathodes (20), a gate electrode (24) comprised of an electrically conducting material overlying the front surface of the anodic metal oxide layer, wherein said pore walls between said gate electrode and said individual field emitting cathodes are free of said electrically conducting material, and an address electrode (28) overlying the back surface of the anodic metal oxide layer and in electrical contact with the back ends of the wires, wherein the front ends of the individual field emitting cathodes are approximately level with the front surface of the anodic metal oxide layer.

6. A method of making a field emitter device by the steps of:

a) providing a porous dielectric anodic metal oxide layer (10) having a front surface (12) and a back surface (14) and an array of pores (16) extending through the anodic metal oxide layer from the front surface to the back surface, b) providing wires (18) in the pores having back ends (22) and front ends to constitute individual field emitting cathodes (20), c) providing a gate electrode (24) comprised of an electrically conducting material overlying the front surface of the anodic metal oxide layer, and d) providing an address electrode (28) overlying the back surface of the anodic metal oxide layer and in electrical contact with the back ends of the wires, characterized by subjecting the product of step c) to a liquid which cleans pore walls intermediate to the individual field emitting cathodes and the gate electrode, to reduce the extent of short circuits between the address electrode and the gate electrode and to provide a device wherein material of the gate electrode is substantially not present within overlying walls of the pores, and wherein the front ends of the individual field emitting cathodes are approximately level with the front surface of the anodic metal oxide layer.

7. The method as claimed in claim 6, wherein the pore wall cleaning step is performed before emitter cones (20) are formed on the front ends of the wires.

8. The method as claimed in claim 6, wherein the pore wall cleaning step is performed after emitter cones (20) have been formed on the front ends of the wires.

9. The method as claimed in claim 6, wherein a resistive layer (26) is provided between the back ends of the wires and the address electrode.

10. The method as claimed in claim 6, wherein the dielectric anodic metal oxide layer is comprised of aluminum oxide, the wires are comprised of nickel having emitter cones comprised of molybdenum, and the gate electrode is comprised of niobium or titanium or tantalum.

11. A method of making a field emitter device by the steps of:

a) providing a porous dielectric anodic metal oxide layer (10) having a front surface (12) and a back surface (14) and an array of pores (16) having walls extending through the anodic metal oxide layer from the front surface to the back surface, b) providing wires (18) in the pores having back ends (22) and front ends to constitute individual field emitting cathodes (20), c) providing a gate electrode (24) comprised of an electrically conducting material overlying the front surface of the anodic metal oxide layer, d) removing electrically conducting material from the pore walls between the gate electrode and the individual field emitting cathodes, and e) providing an address electrode (28) overlying the back surface of the anodic metal oxide layer and in electrical contact with the back ends of the wires, wherein the front ends of the individual field emitting cathodes are approximately level with the front surface of the anodic metal oxide layer.

* * * * *